United States Patent [19]

Wilson et al.

[11] 3,988,198

[45] Oct. 26, 1976

[54] METHOD FOR TREATING HEMI CAUSTIC EFFLUENTS

[75] Inventors: Jim Degnan Wilson, Olympia; Andrew Beelik, Shelton, both of Wash.; Herbert Lawrence Hergert, Morris County; Reid Logan Mitchell, Morristown, both of N.J.

[73] Assignee: International Telephone and Telegraph Corporation, New York, N.Y.

[22] Filed: Oct. 7, 1974

[21] Appl. No.: 512,487

Related U.S. Application Data

[63] Continuation of Ser. No. 365,517, May 31, 1973, abandoned, which is a continuation of Ser. No. 183,273, Sept. 23, 1971, abandoned.

[52] U.S. Cl. ..... 162/30 R; 162/42; 423/183; 423/206 R

[51] Int. Cl.[2] ..... D21C 11/04; C01D 1/36

[58] Field of Search ..... 162/29, 30 R, 31, 42, 162/38; 423/183, 206, 207

[56] References Cited

UNITED STATES PATENTS

| | | | |
|---|---|---|---|
| 2,774,666 | 12/1956 | Barton | 162/31 |
| 3,174,896 | 3/1965 | Partlow | 162/38 |

*Primary Examiner*—S. Leon Bashore
*Assistant Examiner*—Richard V. Fisher
*Attorney, Agent, or Firm*—J. B. Raden; H. J. Holt

[57] ABSTRACT

Spent hemi caustic effluents from cold caustic extraction of cellulosic pulps are rendered utilizable as a source of sodium hydroxide for pulp processing by heating the effluents for a period of time and at a temperature sufficient to cause the hemicelluloses in the effluents to be degraded and to substantially eliminate precipitation of the hemicelluloses onto cellulosic materials when the effluents are used.

6 Claims, No Drawings

METHOD FOR TREATING HEMI CAUSTIC EFFLUENTS

This is a continuation of application Ser. No. 365,517, filed May 31, 1973, and now abandoned; which in turn is a continuation of application Ser. No. 183,273, filed Sept. 23, 1971, and now abandoned.

This invention relates to a new and improved method for recovering and reutilizing pulping chemicals from waste effluents produced during the manufacture of dissolving pulps. More particularly, it relates to a method for treating spent effluents from the cold caustic extraction of cellulosic pulps (hereinafter referred to as hemi caustic effluents) to produce reusable caustic solutions.

It has been long known that the waste hemi caustic effluents from a cold caustic extraction process contain almost as much caustic soda as the unused extraction solution. However, utilization of these effluents as a source of caustic has not been feasible because of the presence in the effluents of dissolved polysaccharide contaminants such as hemicelluloses, cellulosic fragments and the like. These contaminants (which are hereinafter referred to as hemicelluloses) tend to deposit onto pulp fibers when the effluents are used in cooking, bleaching or caustic extraction of untreated pulps. This depositing of hemicelluloses onto cellulosic fibers increases the caustic soluble portion of the finished pulp, thereby rendering it unfit for important end uses.

Therefore, after very limited usage, the substantial content of valuable caustic soda in spent caustic extraction effluents has been discarded without further utilization in the processing of pulps. This will be recognized to impose a serious economic burden on the manufacturer. Additionally, these effluents have become a direct burden on the processors since their disposal into the waterways has been prohibited by law and this has led to expensive measures for their elimination. Thus, it would be extremely advantageous and commercially important to provide a method for utilization of the hemi caustic effluents since a considerable saving in caustic soda would result and, also, a far more limited disposal problem would be encountered.

Utilization of hemi caustic effluents has been the subject of considerable research for many years, but no process has previously been found which was acceptable from the standpoint of both efficiency and economy. The methods investigated included both physical and chemical procedures but none of them adequately solved the existing problem of providing an economical and efficient process for treating the effluents to enable their use in pulp manufacture.

Exemplary of prior techniques studied in an attempt to find a method for utilization of hemi caustic effluents was the evaporation of effluents by heating at atmospheric pressure or under vacuum. This method resulted in only partial removal of dissolved hemicelluloses and, therefore, was not effective or practical. Pyrolysis of evaporated hemi caustic effluents at 500°–600° C. was not satisfactory particularly since extensive conversion of sodium hydroxide to sodium carbonate was encountered. Addition of chlorine to the hemi caustic liquor followed by heating at temperatures up to about 100° C. caused destruction of the dissolved hemicellulose but this procedure was not economically successful. Other methods involving the physical separation of the hemicelluloses from the hemi caustic effluents (as, for example, by dialysis or osmotic separation) have proved to be too time-consuming and expensive as well as presenting extreme equipment and operational difficulties.

It is therefore an object of the present invention to provide an economical and efficient method which enables the utilization of spent hemi caustic effluents from cold caustic extraction of pulps.

Another object is to provide a method for treating spent hemi caustic effluents in a manner such that deposition of soluble hemicelluloses present in the effluent onto cellulosic fiber is substantially eliminated when the hemi caustic solutions are reused. A related object is to provide a method of treating spent hemi caustic effluents so that these effluents can be used for cooking, bleaching or caustic extraction of pulps, thus reducing production costs and alleviating effluent disposal problems.

Additional objects, if not specifically set forth herein will be apparent to one skilled in the art from the following detailed description of the invention.

The present invention is based on our discovery that thermal degradation of the hemicelluloses dissolved in spent hemi caustic effluents renders these effluents suitable for use in cooking, bleaching and refining of dissolving pulps without adverse effect on the quality of the pulps. We have found that heat treatment of hemi caustic effluents causes the dissolved hemicelluloses therein to become innocuous and substantially eliminates precipitation or deposition of the hemicelluloses onto cellulosic materials when the effluents are used.

The heat treatment of the hemi caustic effluents is carried out under conditions which do not cause charring of the hemicelluloses and, also, do not adversely affect the suitability of the caustic soda in the heat treated effluent for utilization in pulping and pulp refining operations. In fact, we have found that the heat-treated effluents can be used as a source of sodium hydroxide directly in cooking, bleaching or hot caustic extraction; and, after concentration or after addition of made-up sodium hydroxide, they can also be used for cold caustic extraction. Furthermore, we have found that the spent hemi caustic effluents can be recycled and reused numerous times when subjected to heat treatment by the method of the present invention. For example, analytical and end use properties of pulp have been found to be successfully maintained over twelve recyclings of a hemi caustic effluent heat treated in accordance with the present invention when employed at 85% reutilization levels in cold caustic extractions.

Thus, we have discovered that the long standing problem regarding utilization of spent hemi caustic effluents is solved by a simple, efficient and economical process depending exclusively on heat treatment for regeneration of the hemi caustic liquors. No auxiliary agents and treatments are required and the resulting regenerated liquor is suitable for reuse without further treatment.

In accordance with our invention, hemicellulose-containing effluents from the cold caustic extraction of cellulosic pulps are heated to a temperature in the range of from about 140° to about 240°, preferably about 175° – 200° C., for a period of time sufficient to cause thermal degradation of the hemicelluloses in the effluent solutions so that the hemicelluloses will no longer precipitate out on cellulosic materials or otherwise interfere with the action of the caustic soda when the effluents are utilized for treating cellulosic material. Normally, the heat treatment is carried out for a period of time of about 30 minutes for higher temperatures within the above range to about 3 hours for temperatures at the lower end of the temperature range, and preferably for about 1–2 hours. However, it is to be recognized that the heating time to be employed in a specific case will vary depending on factors such as the temperature employed, the solution concentration and the like. The resulting product solution obtained by heating the effluent has been found to be in a condition suitable for use wherever a caustic soda solution is required in a pulping operation such as in alkaline cooking liquors, bleaching solutions and the like.

In a preferred embodiment of our invention, spent hemi caustic effluents containing about 4 to 24 percent sodium hydroxide and about 0.5–3.0 percent hemicelluloses are subjected to heat treatment for periods of 15–180 minutes at temperatures of 140° – 240° C. Generally speaking, the time of treatment varies inversely with the temperature. In a typical example, a hemi caustic effluent is heated to 185° C. and retained at that temperature for 54 minutes. The resulting regenerated liquor is then suitable for reutilization as a source of sodium hydroxide directly in cooking, bleaching and hot caustic extraction, or in cold caustic extraction after concentration or addition of make-up sodium hydroxide.

The following examples are set forth for the purpose of illustrating the method of this invention and the characteristics of the resulting products only and are not intended to be construed as being limitative in any respect.

EXAMPLE 1

This example illustrates the effect of time and temperature on the thermal degradation of the hemicelluloses present in hemi caustic effluents. Samples (200 ml. each) of a pulp mill hemi caustic effluent were heated in a 240 ml. screw-cap, stainless steel bomb that was fitted with a thermocouple, a pressure gauge and a relief valve. The filled bomb was clamped into a cradle immersed in a stirred, preheated oil bath. A small motor rocked the cradle and provided sample agitation. Heating experiments were performed according to a statistical design and covered the temperature range from 140° to 200° C. Reaction times varied about 15 to 60 minutes, not including the 10 to 20 minutes required to bring the bomb contents to temperature. Reaction pressures were 20 to 25 psi greater than saturated steam at the same pressure. At the end of the reaction time, the bomb was plunged into cold water and the cooled samples were evaluated employing the following test procedures:

Sodium Hydroxide Concentration

The carbonates present in the samples were precipitated with barium chloride. Then, the alkaline strengths of the remaining solutions were determined by acid titration and reported as % NaOH.

Chemical Oxygen Demand

These values were used as a measure of the total content of organic material, and were determined by oxidative titration with dichromate solution. The chemical oxygen demand corresponds to the grams of oxygen required to oxidize all the organic matter in 100 g. of sample to carbon dioxide and water, reported as % COD.

Methanol-Precipitable Hemicellulose

Defined as the grams of hemicellulose that precipitate when 100 g. of hemi caustic solution is diluted with four volumes of methanol; the value is reported in percent, and is a measure of the higher molecular weight hemicellulose fraction, since the degraded hemicelluloses do not precipitate.

Hemicellulose Degradation

This is a measure of thermal degradation, and is expressed by the percentage decrease in methanol-precipitable hemicellulose present in a heated sample as compared with a control sample which has not been subjected to heating.

The results achieved in this testing are set forth in the following table:

TABLE I

| Treatment Conditions | | Evaluation of Heat-Treated Hemi Caustic | | | |
|---|---|---|---|---|---|
| Reaction Temperature, ° C. | Reaction Time, Min. | NaOH Conc. % | COD % | Methanol Precipitable Hemi-Cellulose % | Hemi-Cellulose Degradation % |
| No Heating | 0 (Control) (Sample) | 7.52 | 1.56 | 1.22 | 0 |
| 140 | 21 | 7.33 | 1.45 | 0.93 | 23.8 |
| " | " | 7.34 | 1.45 | 0.94 | 23.0 |
| " | 54 | 7.27 | 1.45 | 0.90 | 26.2 |
| " | " | 7.36 | 1.45 | 0.90 | 26.2 |
| 163 | 15 | 7.26 | 1.40 | 0.82 | 32.8 |
| " | " | 7.24 | 1.41 | 0.83 | 32.0 |
| " | 38 | 7.28 | 1.40 | 0.79 | 35.3 |
| " | " | 7.05 | 1.46 | 0.62 | 49.2 |
| " | " | 7.20 | 1.34 | 0.71 | 41.8 |
| " | " | 7.23 | 1.38 | 0.75 | 38.5 |
| " | 60 | 7.12 | 1.32 | 0.62 | 49.2 |
| " | " | 7.13 | 1.34 | 0.66 | 44.1 |
| 185 | 21 | 6.96 | 1.28 | 0.40 | 67.2 |
| " | " | 7.10 | 1.24 | 0.47 | 61.5 |
| " | 54 | 7.02 | 1.21 | 0.36 | 70.5 |
| " | " | 6.96 | 1.17 | 0.23 | 81.1 |
| 200 | 38 | 6.94 | 1.09 | 0.12 | 90.2 |
| " | " | 6.96 | 1.09 | 0.14 | 88.6 |

The tabulated evaluation results showed that with regard to the sodium hydroxide concentration of the heat treated effluents as compared with the control sample, heat treatment caused only a small decrease in this value. This indicated that caustic consumption resulting from the heat treatment of the effluents was minimal.

It is to be particularly noted that the methanol-precipitable hemicelluloses decrease significantly upon heating of the samples, especially at the higher temperatures. Thus, substantial degradation of the hemicelluloses in the samples is shown to be achieved as a result of heating the effluent samples.

The COD values decreased only moderately even under the severest heating conditions, showing that complete oxidative destruction of organic matter is much more limited than hemicellulose degradation.

The substantial degree of degradation of hemicelluloses resulting from the method of the present invention again is demonstrated by the results tabulated under the heading hemicellulose degradation % wherein the degradation is shown to be markedly increased with heating severity.

EXAMPLE II

A supply of typical hemi caustic effluent was obtained from a pulp mill and heated at 185° C. for 60 minutes. The heating equipment was a 2.8-liter stainless steel digester that circulated the contents through a steam-heated heat exchanger. About 15 minutes were required to bring the hemi caustic effluent to temperature. Cooling at the end of the treatment also took 15 minutes. Four batches of hemi caustic effluent were heated in this matter, and combined to give a total of 10 liters. The heat-treated effluent was filtered through glass wool to remove a small amount of insoluble material, and analyzed. The results of this analysis are set forth in the following table:

TABLE II

| | Sodium Hydroxide Conc. % | COD % | Methanol-Precipitable Hemicellulose % | Hemi-cellulose Degradation % |
|---|---|---|---|---|
| Hemi caustic effluent (No heating-control) | 7.4 | 1.25 | 0.99 | 0 |
| Heat-treated hemi caustic effluent | 6.6 | 0.86 | 0.16 | 83.8 |

These results again demonstrate the effectiveness of the present method in degrading the hemicelluloses in the effluent without unduly effecting the sodium hydroxide concentration of the liquor.

EXAMPLE III

This example illustrates the utilization of the caustic in a heat-treated hemi caustic effluent in the kraft cooking of southern pine wood. A small batch (3.2 kg. oven dried basis) of wood chips was placed in an experimental digester and pulped by the prehydrolyzed kraft process using the heat-treated hemi caustic effluent from Example II as the only source of sodium hydroxide in the white liquor makeup. Parallel experiments were carried out using (1) untreated hemi caustic effluent and (2) flake caustic for the sodium hydroxide requirements. Pulping was carried out employing a conventional prehydrolysis first stage followed by a second stage alkaline treatment. The conditions of this second stage treatment were as follows:

| | |
|---|---|
| Maximum temperature, ° C. | 170 |
| Time to max. temperature, min. | 90 |
| Time at max. temperature, min. | 120 |
| Total liquid to wood ratio | 4.4 |

-continued

| | |
|---|---|
| NaOH (as $Na_2O$) to wood ratio | 0.12 |
| $Na_2S$ (as $Na_2O$) to wood ratio | 0.05 |
| Total $Na_2O$ to wood ratio | 0.17 |

Each pulp resulting from this second stage treatment was bleached by a typical four-stage sequence (chlorination, hypochlorite treatment, hot caustic extraction and chlorine dioxide treatment). The bleached pulps were characterized by four properties that would reflect the extent of hemicellulose retention as a consequence of the different pulping conditions. The results were as follows:

TABLE II

| Source of Caustic Used in Pulping | $S_{10}$ %* | $S_{18}$ %* | Xylan %* | Mannan %* |
|---|---|---|---|---|
| Flake Caustic (Control) | 3.8 | 2.1 | 1.6 | 0.9 |
| Untreated Hemi Caustic Effluent | 5.6 | 4.1 | 2.4 | 1.4 |
| Heat-Treated Hemi Caustic Effluent | 4.3 | 2.8 | 1.7 | 1.1 |

*Percents are based on dry bleached pulp.

The solubility of the pulp in 10 and 18% aqueous sodium hydroxide ($S_{10}$ and $S_{18}$), and the level of xylans and mannans are all a measure of the hemicellulose content of a pulp. As indicated in the above table, the pulp cooked with untreated hemi caustic effluent as compared with the control was high in hemicelluloses indicating that considerable amounts of hemicellulosic material had deposited on the pulp from the pulping liquor. Heat-treating the hemi caustic effluent prior to cooking liquor makeup was shown to greatly reduce the effects of deposition and to provide a suitable pulp product.

EXAMPLE IV

A hemi caustic effluent (7.6% NaOH, 2.1% COD, 0.84% methanol-precipitable hemicellulose) was heated 1 hour at 190° C. in a 1-liter Hastelloy autoclave and used in the makeup of a 9.5% caustic solution employed for a cold caustic extraction (37° C., 3% consistency, 15 min.) of a partially bleached, prehydrolyzed kraft, southern pine dissolving pulp (60 g. dry weight). The extraction liquor was then recovered, reheated (1 hr. at 190°), analyzed, reconstituted by addition of reagent caustic to bring the caustic concentration back to 9.5%, and reused in the extraction of a second 60-g. pulp sample. This recycling was continued until the hemi caustic effluent had been heated twelve times and used in 12 extractions. Each successive extraction liquor contained 84% ± 1% recycled heat-treated hemi caustic, which provided 81% ± 1% of the sodium hydroxide content. The balance of each extraction solution was water and reagent caustic. The pulp after each cold caustic extraction, was analyzed, and the results compared with control experiments using hemicellulose-free caustic, and with a three-member extraction series in which hemi caustic was recycled without the benefit of heat-treatment. The results were as follows:

TABLE IV

| Hemi Caustic Liquor | | | | Hemi-Caustic Liquor in Extraction Solution | | Analytical Properties of Extracted Pulp | | | | | | |
|---|---|---|---|---|---|---|---|---|---|---|---|---|
| Type | Cycle | COD % | Methanol Precipitable Hemicellulose (%) | % of Soln[a] | % of NaOH[b] | $S_{10}$ % | $S_{18}$ % | Xyl. % | Man. % | I.V. dl/g | Lim. I.V. dl/g | ELB % |
| Starting Stock | | | | | | 5.6 | 4.2 | 2.6 | 2.2 | 5.86 | 0.96 | 86.6 |
| Heated hemi caustic effluent | 1 | 0.79 | 0.09 | 91 | 72 | 2.2 | 1.1 | 0.8 | 1.0 | 5.63 | 0.82 | 86.0 |
| " | 2 | 0.81 | 0.03 | 85 | 81 | 2.0 | 1.1 | — | — | 5.46 | 0.81 | 85.8 |
| " | 3 | 0.76 | 0.04 | 83 | 81 | 2.1 | 1.3 | — | — | 5.61 | 0.82 | 86.4 |
| " | 4 | 0.75 | 0.02 | 85 | 82 | 2.1 | 1.3 | — | — | 5.63 | 0.82 | 86.7 |
| " | 5 | 0.72 | 0.03 | 85 | 82 | 2.0 | 1.2 | 0.7 | 0.9 | 5.62 | 0.82 | 87.2 |
| " | 6 | 0.72 | 0.03 | 85 | 81 | 2.2 | 1.4 | — | — | 5.25 | 0.83 | 85.8 |
| " | 7 | 0.72 | 0.03 | 84 | 80 | 2.1 | 1.4 | — | — | 5.62 | 0.81 | 85.5 |
| " | 8 | 0.69 | 0.10 | 85 | 82 | 2.1 | 1.4 | — | — | 5.46 | 0.80 | 84.9 |
| " | 9 | 0.69 | 0.09 | 84 | 82 | 2.1 | 1.4 | — | — | 5.52 | 0.82 | 86.6 |
| " | 10 | 0.69 | 0.08 | 84 | 82 | 2.1 | 1.4 | 0.8 | 1.0 | 5.58 | 0.83 | 87.4 |
| " | 11 | 0.63 | 0.06 | 84 | 81 | 2.4 | 1.5 | — | — | 5.64 | 0.84 | 87.6 |
| " | 12 | 0.65 | 0.05 | 85 | 82 | 2.3 | 1.5 | — | — | 5.46 | 0.82 | 87.7 |
| Hemicellulose-free liquor | — | — | — | — | — | 2.2 | 1.5 | 0.7 | 1.0 | 5.46 | 0.83 | 87.7 |
| " | — | — | — | — | — | 2.2 | 1.1 | — | — | 5.34 | 0.83 | 85.9 |
| Unheated hemi caustic effluent | 1 | 1.07 | 0.84 | 90 | 72 | 3.4 | 2.3 | 1.2 | 1.3 | 5.64 | 0.87 | 88.2 |
| " | 2 | 1.10 | 0.87 | 85 | 82 | 2.9 | 2.2 | — | — | 5.73 | 0.84 | 88.6 |
| " | 3 | 1.07 | 0.89 | 85 | 79 | 3.0 | 2.2 | — | — | 5.58 | 0.81 | 88.8 |

[a]Percent hemi caustic liquor present in extraction solution
[b]Percent of NaOH in extraction solution that came from hemi caustic liquor The $S_{10}$, $S_{18}$, xylan and mannan values given in the table show that cold caustic extractions using recycled heat-treated hemi caustic effluent were as effective as the hemi-free control in providing pulp that was low in hemicellulose. On the other hand, pulp extracted with liquors made from recycled, unheated hemi caustic effluent were significantly higher in hemicellulose. Use of a heated hemi caustic effluent did cause a small loss in pulp brightness (% ELB) which could readily be corrected in a subsequent bleaching stage. Viscosity properties (I.V. and limit I. V.) were unaffected by either heated or unheated hemi caustic effluent.

EXAMPLE V

In this example, hemi caustic solutions of varying composition were heated at 190° C. for 2 hours. At 15 minute intervals during the 2 hour period, samples were taken and analyzed for methanol-precipitable hemicellulose. The thermal treatment was carried out in a 144-liter, steam-jacketed autoclave equipped with a low-speed mixer. A heating period of about 45 minutes was required to reach 190° C.

TABLE V

| Methanol-Precipitable Hemicellulose in Heat-Treated Effluent, % | | | | | | | | |
|---|---|---|---|---|---|---|---|---|
| Heating time at 190° C.(Minutes) | | | | | | | | |
| 0* | 15 | 30 | 45 | 60 | 75 | 90 | 105 | 120 |
| 2.05 | 1.32 | 1.07 | 0.81 | — | — | 0.60 | — | 0.69 |
| 0.73 | 0.56 | 0.42 | 0.29 | 0.24 | 0.15 | 0.15 | 0.09 | 0.06 |
| 0.10 | 0.04 | 0.04 | 0.03 | 0.01 | 0.01 | 0.01 | 0.01 | 0.01 |
| 0.29 | 0.29 | 0.11 | 0.06 | 0.04 | 0.06 | 0.06 | 0.07 | 0.03 |

*Starting concentration of methanol-precipitable hemicelluloses in a hemi caustic effluent.

This example illustrates the use of heat-treated hemi caustic effluent in cold caustic extraction of chemical cellulose made from wood pulp. The pulp was cooked from southern pine chips by the prehydrolyzed kraft process and then bleached by consecutive application of chlorination, hypochlorite treatment, hot caustic extraction and chlorine dioxide treatment. Bleach pulp (2.65 kg.) was extracted 15 minutes at 25° C. and 3% consistency with aqueous sodium hydroxide (9.5% NaOH) in which 50% of the caustic was added in the form of a hemi caustic effluent that was heat-treated at 190° C. for 1 hour according to Example V. After washing and treatment with aqueous $SO_2$, dewatering and drying, the extracted pulp was analyzed to determine caustic solubility ($S_{10}$, $S_{18}$), hemicellulose content (xylan, mannan) and brightness (ELB). The caustic filtrate (effluent) from this extraction was heat-treated (190° C. for 1 hour) according to Example V, and this heated hemi caustic effluent served as 50% of the caustic makeup in a second cold caustic extraction conducted exactly as outlined earlier in this example, except for lowering NaOH concentration to 9.3%. Recovery, heating and 50% reuse of the effluent was repeated again using 9.1% NaOH.

In each extraction fresh portions of hemicellulose entered the caustic solution from the pulp, and were then degraded in the ensuing heat treatment. For comparison, other portions of the same pulp were also extracted under identical conditions with hemicellulose-free aqueous sodium hydroxide (9% NaOH), and with caustic solutions in which 50% and 100% the NaOH was derived from untreated hemi caustic effluent (9.5% NaOH in these two extractions). The caustic and hemicellulose contents of the various extraction liquors, and analytical properties of the extracted pulps are given in the following table:

TABLE VI

| Caustic Solution Used in Pulp Extraction | | | Pulp Analyses | | | | | |
|---|---|---|---|---|---|---|---|---|
| Source Of NaOH | NaOH % | COD % | Times Recycled | $S_{10}$ % | $S_{18}$ % | Xylan % | Mannan % | ELB % |
| Hemicellulose-Free Liquor | 9.0 | — | — | 1.2 | 1.1 | 0.6 | 0.8 | 87.0 |
| Untreated Hemi Caustic Effluent (100%) | 9.5 | 1.21 | — | 1.7 | 1.5 | 0.7 | 1.0 | 86.7 |
| Untreated Hemi Caustic Effluent | 9.5 | 0.62 | — | 1.2 | 1.2 | 0.7 | 0.9 | 86.4 |

TABLE VI-continued

| Caustic Solution Used in Pulp Extraction | | | | Pulp Analyses | | | | |
|---|---|---|---|---|---|---|---|---|
| Source Of NaOH | NaOH % | COD % | Times Recycled | $S_{10}$ % | $S_{18}$ % | Xylan % | Mannan % | ELB % |
| (50%) Heated Hemi Caustic Effluent (50%) | 9.5 | 0.43 | — | 0.8 | 0.8 | 0.5 | 0.8 | 84.4 |
| Heated Hemi Caustic Effluent (50%) | 9.3 | 0.25 | 1 | 1.0 | 1.0 | 0.5 | 0.7 | 82.6 |
| Heated Hemi Caustic Effluent (50%) | 9.1 | 0.19 | 2 | 1.1 | 1.1 | 0.5 | 0.7 | 86.9 |

The tabulated data shows that heat treatment of the hemi caustic effluent allowed gradual lowering of the extraction concentration from 9.5% NaOH to 9.1% NaOH, without adverse effect on caustic solubility and hemicellulose content of the extracted pulp and with only minor reduction of brightness. By comparison, use of 100% untreated hemi caustic effluent at 9.5% NaOH increased caustic solubilities and hemicellulose content significantly and use of 50% untreated hemi caustic effluent at 9.5% NaOH barely matched S10, S18, xylan and mannan levels attained in extraction with hemi-free caustic at 9.0% NaOH.

EXAMPLE VII

This example illustrates the use of heat-treated hemi caustic effluent in hypochlorite treatment and hot caustic extraction of pulps cooked from southern pine chips by the prehydrolyzed kraft process. Hypochlorite treatment and hot caustic extraction were the second and third of four stages in an incomplete bleach sequence. The first stage involved chlorination of the unbleached pulp, the fourth stage was a chlorine dioxide treatment. Evaluation of the effect of using heated hemi caustic effluent included analysis of pulps after the fourth bleaching stage for caustic solubility (S10, S18), hemicellulose content (xylan, mannan) and brightness (ELB). In three parallel experiments with 3-kg. batches of pulps, all the caustic used in the second and third bleaching stages came from (1) hemicellulose-free caustic liquor (2) untreated hemi caustic effluent (containing 1.3% methanol-precipitable hemicellulose) and (3) hemi caustic effluent heat-treated (190° C. for 1 hour) according to Example V (containing 0.13% methanol-precipitable hemicellulose after the heat treatment). The conditions of the second bleaching stage (hypochlorite treatment) were: addition of 3.7% $Cl_2$ and 2.3% NaOH (both based on O.D. pulp) 32° C., 8% consistency, and 50 min. duration; the conditions of the third bleaching stage (hot caustic extraction) were: addition of 1.2% NaOH (O.D. pulp basis), 85° C., 10% consistency, and 20 min. duration, in all three experiments. Conditions of the first and fourth bleaching stages were those commonly used in the preparation of chemical cellulose, and uniform in all three experiments. Variables and data from pulp analyses are given in the following tabulation.

TABLE VII

| Source of Caustic in | | Analyses on Pulp Following the Fourth Bleaching Stage | | | | |
|---|---|---|---|---|---|---|
| Hypochlorite Treatment (2nd Stage) | Hot Caustic Extraction (3rd Stage) | $S_{10}$ % | $S_{18}$ % | Xylan % | Mannan % | ELB % |
| Hemicellulose-Free Liquor | | 6.1 | 3.1 | 1.7 | 1.1 | 87.6 |
| Hemi Caustic Effluent (Untreated) | | 6.8 | 4.0 | 2.1 | 1.2 | 87.2 |
| Heat-Treated Hemi Caustic Effluent | | 6.1 | 3.2 | 1.8 | 1.1 | 87.3 |

Properties of pulp bleached using heat-treated hemi caustic effluents were thereby demonstrated to match those of pulp bleached with hemi-free caustic, while the pulp bleached with untreated hemi caustic effluent had higher caustic solubilities and hemicellulose contents.

While the principles of this invention have been described above in connection with specific apparatus and applications, it is to be understood that this description is made only by way of example and not as a limitation on the scope of the invention.

We claim:

1. A process for treating spent hemicaustic effluent from a cold caustic extraction of cellulosic pulp containing about 0.5 to 3.0% hemicellulose and from about 4 to 24% sodium hydroxide to recover and reuse the caustic values therein, said process consisting essentially of heating said effluent to a temperature in the range of about 175°–200° C for a period of time sufficient to cause thermal degradation of hemicelluloses in said effluent whereby deposition of said hemicelluloses on cellulosic material upon use of said effluent is substantially eliminated, recovering said effluent and employing said effluent containing said degraded hemicellulose as a source of sodium hydroxide in subsequent pulp processing operations.

2. The process of claim 1 wherein said time period of heating is from about 30 to about 180 minutes.

3. The process of claim 2 wherein said effluent is utilized as a source of sodium hydroxide in a pulp treatment process selected from the group consisting of cooking liquors, bleaching solutions, hot caustic extraction liquors and cold caustic extraction liquors.

4. A process for treating hemicaustic effluents from a cold caustic extraction of cellulosic pulps containing from about 0.5 to 3.0% hemicellulose and from about 4 to 24% sodium hydroxide to enable use of said effluents in pulping processes, said process consisting essentially of subjecting said effluents to a heat treatment at a temperature of about 175°–200° C, said heat treatment causing hemicelluloses dissolved in said effluent to be thermally degraded, substantially eliminating precipitation of said hemicelluloses onto cellulosic materials when said effluents containing said degraded hemicelluloses are used as a source of sodium hydroxide.

5. The process of claim 4 wherein said heat treatment is carried out for a period of time of about 30–180 minutes.

6. The process of claim 4 wherein said effluents are used for processing pulps in a pulp processing procedure selected from the group consisting of cooking, bleaching, hot caustic extraction and cold caustic extraction.

* * * * *